US006325484B1

(12) United States Patent
Usui

(10) Patent No.: US 6,325,484 B1
(45) Date of Patent: Dec. 4, 2001

(54) METHOD OF REMOVING AIR BUBBLES FROM INK SUPPLY PASSAGE IN INK JET RECORDING APPARATUS AND INK JET RECORDING APPARATUS CAPABLE OF EMPLOYING SAID METHOD

(75) Inventor: Minoru Usui, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/010,585

(22) Filed: Jan. 22, 1998

(30) Foreign Application Priority Data

Jan. 24, 1997 (JP) ..... 9-026076

(51) Int. Cl.[7] ..... B41J 2/165; B41J 2/19
(52) U.S. Cl. ..... 347/30; 347/92
(58) Field of Search ..... 347/86, 87, 30, 347/33, 85, 92, 29

(56) References Cited

U.S. PATENT DOCUMENTS

| | | | | |
|---|---|---|---|---|
| 4,025,928 | * | 5/1977 | Hou et al. | 347/87 |
| 4,589,000 | * | 5/1986 | Koto et al. | 346/140 R |
| 4,999,643 | | 3/1991 | Terasawa . | |
| 5,221,936 | * | 6/1993 | Saito et al. | 347/86 |
| 5,343,228 | * | 8/1994 | Takada | 347/29 |
| 5,606,353 | * | 2/1997 | Mochizuki | 347/23 |
| 5,701,146 | * | 12/1997 | Akiyama et al. | 347/30 |
| 5,812,155 | * | 9/1998 | Seccombe | 347/30 |
| 5,910,808 | * | 6/1999 | Fukasawa et al. | 347/30 |
| 5,912,689 | * | 6/1999 | Otsuka et al. | 347/86 |

FOREIGN PATENT DOCUMENTS

| | | | | |
|---|---|---|---|---|
| 2 184 066 | | 6/1987 | (GB) | B41J/3/04 |
| 04185451 | * | 7/1992 | (JP) . | |
| 2822586 | | 9/1998 | (JP) | B41J/3/04 |

OTHER PUBLICATIONS

Patent Abstracts of Japan, vol. 013, No. 398 (M–866), Sep. 5, 1989 & JP 01 141748 A (FUJITSU LTD) Jun. 2, 1989 * Abstract.

* cited by examiner

*Primary Examiner*—N. Le
*Assistant Examiner*—Shih-wen Hsieh
(74) *Attorney, Agent, or Firm*—Sughrue, Mion, Zinn, Macpeak & Seas, PLLC

(57) ABSTRACT

An air-communicated opening (8*a*) of an ink cartridge (8) connected to an ink jet recording head (7) is sealed to apply negative pressure from the suction device (11) to the recording head (7) through a capping unit (10). Ink is forcibly discharged from the recording head (7) until the internal pressure of the ink cartridge (8) is brought into a condition of equilibrium with the sucking pressure of the suction device (11). Thus, air bubbles are discharged to the outside by force of the flow of ink. Then, the pressure of the ink in the ink cartridge (8) is reduced to the sucking pressure to raise the degree of deaeration of the ink.

18 Claims, 5 Drawing Sheets

METHOD OF REMOVING AIR BUBBLES FROM INK SUPPLY PASSAGE IN INK JET RECORDING APPARATUS AND INK JET RECORDING APPARATUS CAPABLE OF EMPLOYING SAID METHOD

BACKGROUND DESCRIPTION OF THE INVENTION

1. Technical Field of the Invention

The present invention relates to an ink jet recording apparatus. More particularly, the present invention is directed to a technique for removing air bubbles existing in an ink passage formed in an ink jet recording apparatus which is arranged to discharge ink droplets through openings of a nozzle thereof.

2. Background of the Related Art

A conventional ink jet recording apparatus comprises a recording head structured in such a manner that an actuator, including a piezoelectric vibrator or heating device or the like, applies pressure to ink in a pressure generating chamber to discharge ink droplets through openings formed in a nozzle thereof. Thus, ink in an opening in the nozzle, from which ink droplets are not discharged in a large quantity during the printing operation, is not renewed. Thus, the viscosity of ink in the opening portion in the nozzle is undesirably raised As a result, the quality of the printed product deteriorates.

To solve the above-mentioned problem, a flushing operation has been performed whenever the printing operation is performed for a predetermined time, e.g., 20 seconds. Thus, the recording head is moved to an ink receiver of a capping unit disposed at a standby position in a non-printing region. Moreover, ink droplets are discharged through the openings in the nozzle regardless of data which must be printed. Another operation has been performed in such a manner that the openings in the nozzle are sealed by the capping unit, and then negative pressure is applied to forcibly discharge ink through the openings in the nozzle.

The operation for forcibly discharging ink through the openings in the nozzle enables ink having raised viscosity and existing near the openings in the nozzle to be removed reliably. Moreover, the foregoing operation enables any air bubble existing in the ink passage in, for example, the recording head, to be removed.

The ink jet recording head which uses a piezoelectric vibrator to serve as the actuator is structured in such a manner that ink droplets are discharged by mechanically changing the capacity of the pressure generating chamber by using displacement of the piezoelectric vibrator. Therefore, controlling the level of a signal which is supplied to the piezoelectric vibrator enables the quantity of ink forming the ink droplet to be adjusted precisely. Thus, a recording apparatus capable of printing an image which must be formed by dense dots can be structured.

To cause a slight displacement of the piezoelectric vibrator to correspond to the quantity of ink forming an ink droplet, the fluid characteristics of the ink existing in the recording head, and more particularly constant compressibility and elastic modulus of the ink, must be maintained. If a large quantity of air is dissolved in the fluid ink, the apparent compressibility of the ink is raised. In this case, the displacement of the piezoelectric vibrator cannot be made to correspond to the change in the pressure of the ink. As a result, the ink discharge characteristic is changed undesirably. To prevent the above-mentioned problem, deaeration of the ink accommodated in the ink cartridge and accommodation of the ink cartridge in an air shielding container to prevent increase of the quantity of dissolved air have been performed.

When the ink cartridge has been mounted on the recording apparatus, air is introduced through an opening which communicates with the atmosphere and which permits ink to be introduced into the recording head. Thus, introduced air is dissolved in ink. The quantity of air dissolved in the ink increases over time. Thus, change in the pressure occurring in the pressure generating chamber for discharging ink droplets causes cavitation to take place. As a result, the reliability of a formed ink droplet deteriorates as compared with that of an ink droplet formed by the ink in an ink cartridge immediately after being discharged from an air shielding container.

When air bubbles, which are generated in the pressure generating chamber and fluid passage after the apparatus has been used for a long time, are removed, ink in the ink cartridge is forcibly substituted for ink existing in the pressure generating chamber if a small quantity of air is dissolved in the ink in the ink cartridge. Thus, air can be dissolved in the ink and the air can easily be removed. However, if the quantity of air dissolved in the ink in the ink cartridge is increased, the air bubbles cannot be dissolved in ink. In this case, there arises a problem in that a large quantity of ink is required to remove the air bubbles because the structure is arranged in such a manner that the air is discharged through the nozzle along the flow of the ink.

SUMMARY OF THE INVENTION

In view of the foregoing, an object of the present invention is to suggest a method of removing air bubbles in an ink supply passage with which air bubbles introduced into the fluid passage of a recording head or the like can reliably be removed with a small quantity of ink-and the degree of deaeration in the ink in an ink cartridge mounted on a recording apparatus can be recovered.

Another object of the present invention is to provide an ink jet recording apparatus with which the method of removing air bubbles can be achieved satisfactorily.

To solve the above-mentioned problems, the present invention is structured to comprise a step of inhibiting the flow of ink from an ink supply connected to an ink jet recording head to the recording head; and a step of applying negative pressure to the recording head to increase the negative pressure level of the recording head.

In a period until the internal pressure in the ink supply is brought into a condition of equilibrium with the sucking pressure of an ink suction pump, air bubbles in the recording head and the like are discharged while the air bubbles are dissolved in the ink. After the equilibrium has been achieved, only air dissolved in the ink in the ink supply is liberated in a quantity corresponding to the negative pressure so as to be discharged into the atmosphere. Thus, the ink is deaerated.

DESCRIPTION OF THE INVENTION

The present invention will now be described with reference to the drawings.

Figure 1:
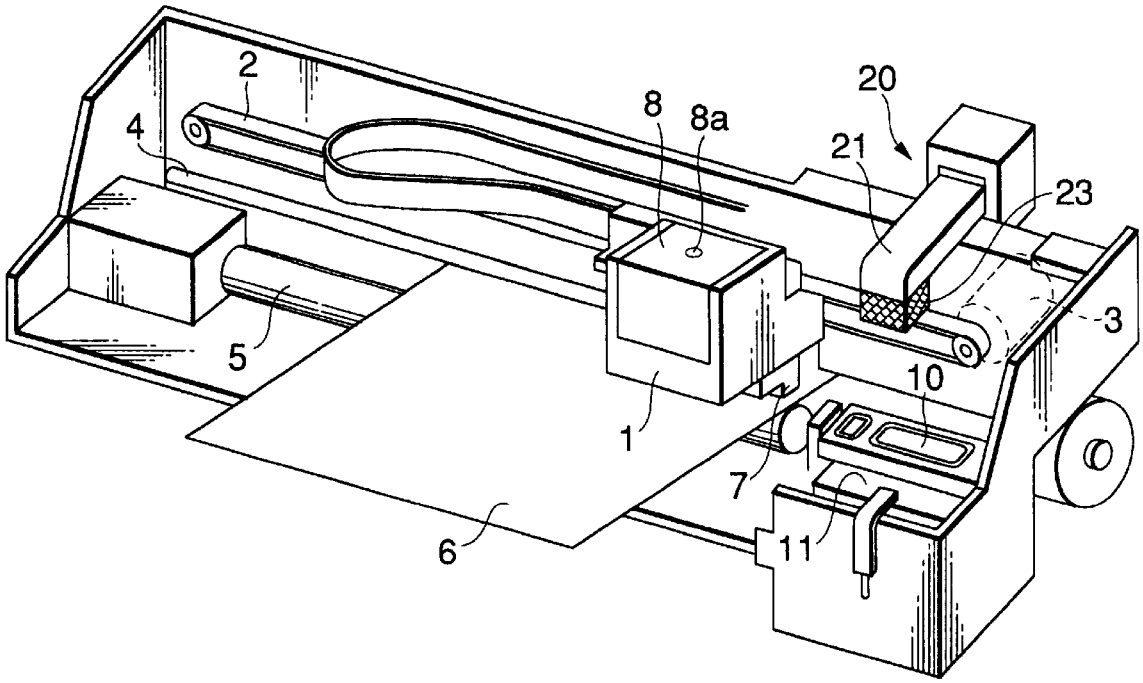
FIG. 1 is a diagram showing an embodiment of the present invention.

FIG. 1 shows an embodiment of an ink jet recording apparatus to which the present invention is applied. A carriage 1 is connected to a motor 3 through a timing belt 2. The carriage 1 is guided by a guide member 4 so that the carriage 1 is capable of reciprocating in the axial direction of a platen 5.

A recording head 7 is provided at a portion of the carriage 1 opposite to recording paper 6. Moreover, an ink cartridge 8 for supplying ink to the recording head 7 is mounted on the carriage 1.

A capping unit 10 for sealing openings in the nozzle of the recording head 7 is disposed in a non-printing region so that the capping unit 10 serves as a sealing means for preventing the openings in the nozzle from becoming dried during interruption of the printing operation. Moreover, the capping unit 10 serves as a member for receiving ink when a flushing operation is performed. In addition, the capping unit 10 serves as an ink suction means for causing negative pressure generated by a suction pump 11 to be applied to the recording head 7 in order to forcibly discharge ink from the recording head 7.

Figure 2:
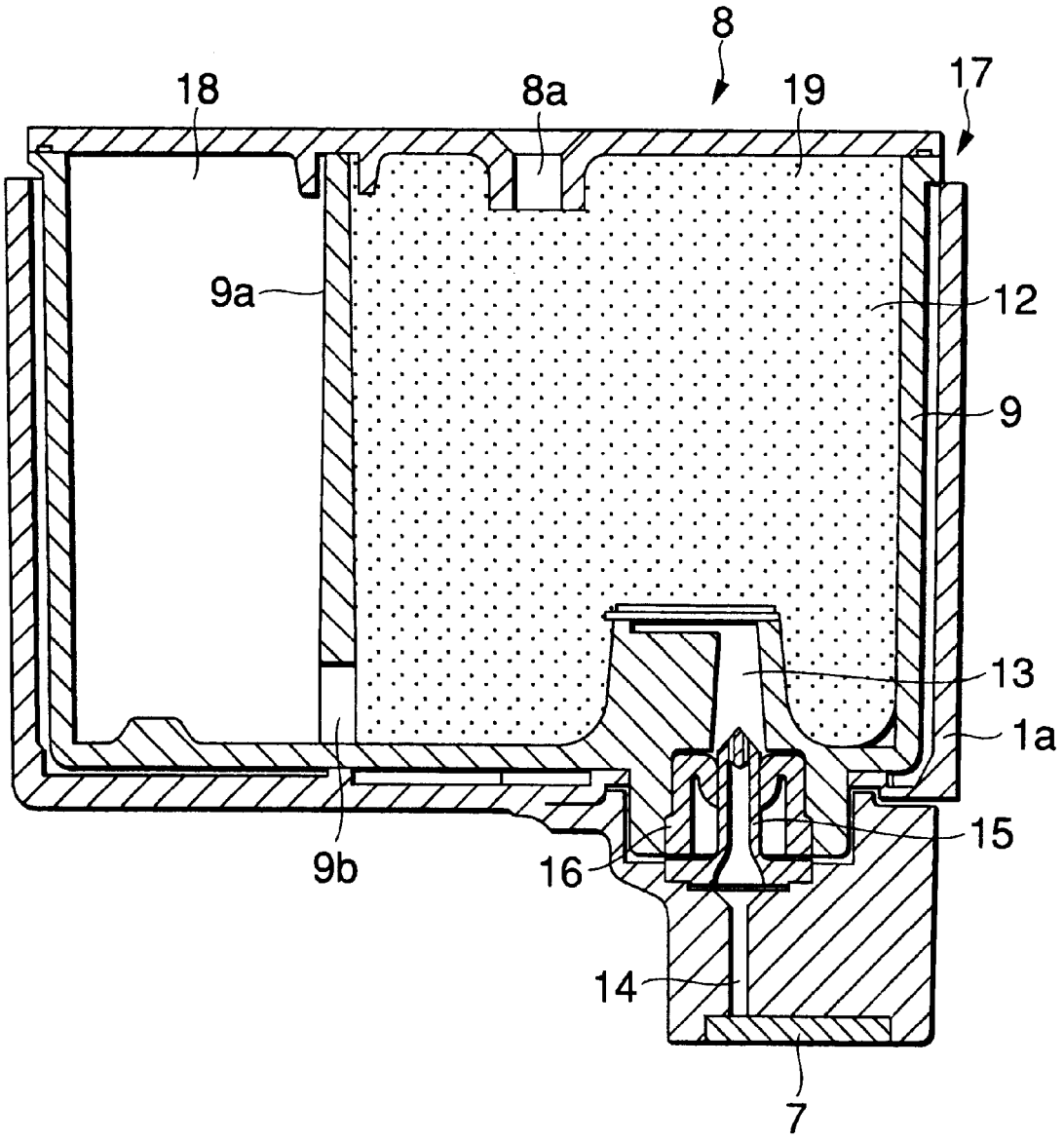
FIG. 2 shows an example of an ink cartridge of the above-mentioned apparatus.

FIG. 2 shows an example of the ink cartridge 8. A container 9 which can be attached to, and detached from, a cartridge receiving portion 1a provided for the carriage 1 is sectioned by a partition plate 9*a* into two chambers 18 and 19 which communicate with each other through a communication hole 9*b*. Ink is directly accommodated in the chamber 18, while an elastic and porous member 12 is accommodated in the other chamber 19. Moreover, an opening formed in the container 9 is sealed by a cover 17 having an air-communicated opening 8*a*. Thus, ink in the ink chamber 18 can be supplied to the recording head 7 through the porous member 12 and the ink supply opening 13.

On the other hand, the recording head 7 has an ink supply needle 15 which communicates with the ink supply passage 14. Thus, the recording head 7 is hermetically connected to the ink cartridge 8 through a packing 16 attached to the ink supply opening 13.

Referring back to FIG. 1, an ink-cartridge sealing mechanism 20 is structured to be capable of sealing the air-communicated opening 8a of the ink cartridge 8 when the recording head 7 has been brought to a capping state during interruption of the printing operation.

Figure 3:
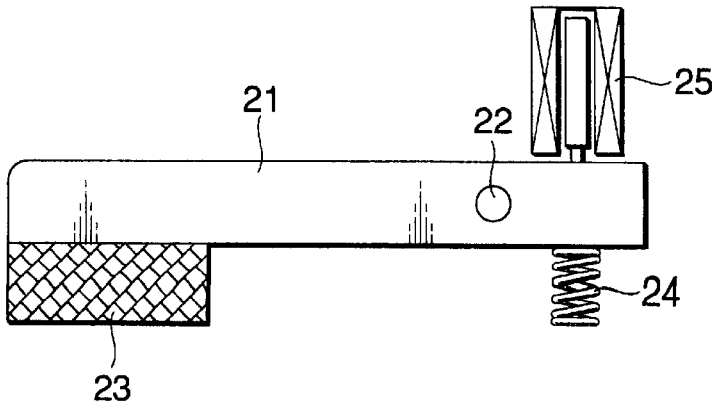
FIG. 3 is a diagram showings an example of an ink-cartridge sealing means of the above-mentioned apparatus.

FIG. 3 shows an example of the ink-cartridge sealing mechanism. An arm 21 is rotatively supported by a shaft 22. The arm 21 has a sealing member 23 made of an elastic member, such as rubber, at an end thereof in such a manner that the sealing member 23 faces the air-communicated opening 8a of the ink cartridge 8. Moreover, the arm 21 has, at another end thereof, a spring 24 for usually urging the sealing member 23 in a direction in which the sealing member 23 is elastically pressed against the air-communicated opening 8*a* of the ink cartridge 8. Moreover, a drive member 25 is provided which receives a drive signal to overcome the urging force of the spring 24 so as to remove the sealing member 23 from a movement passage.

Figure 4A:
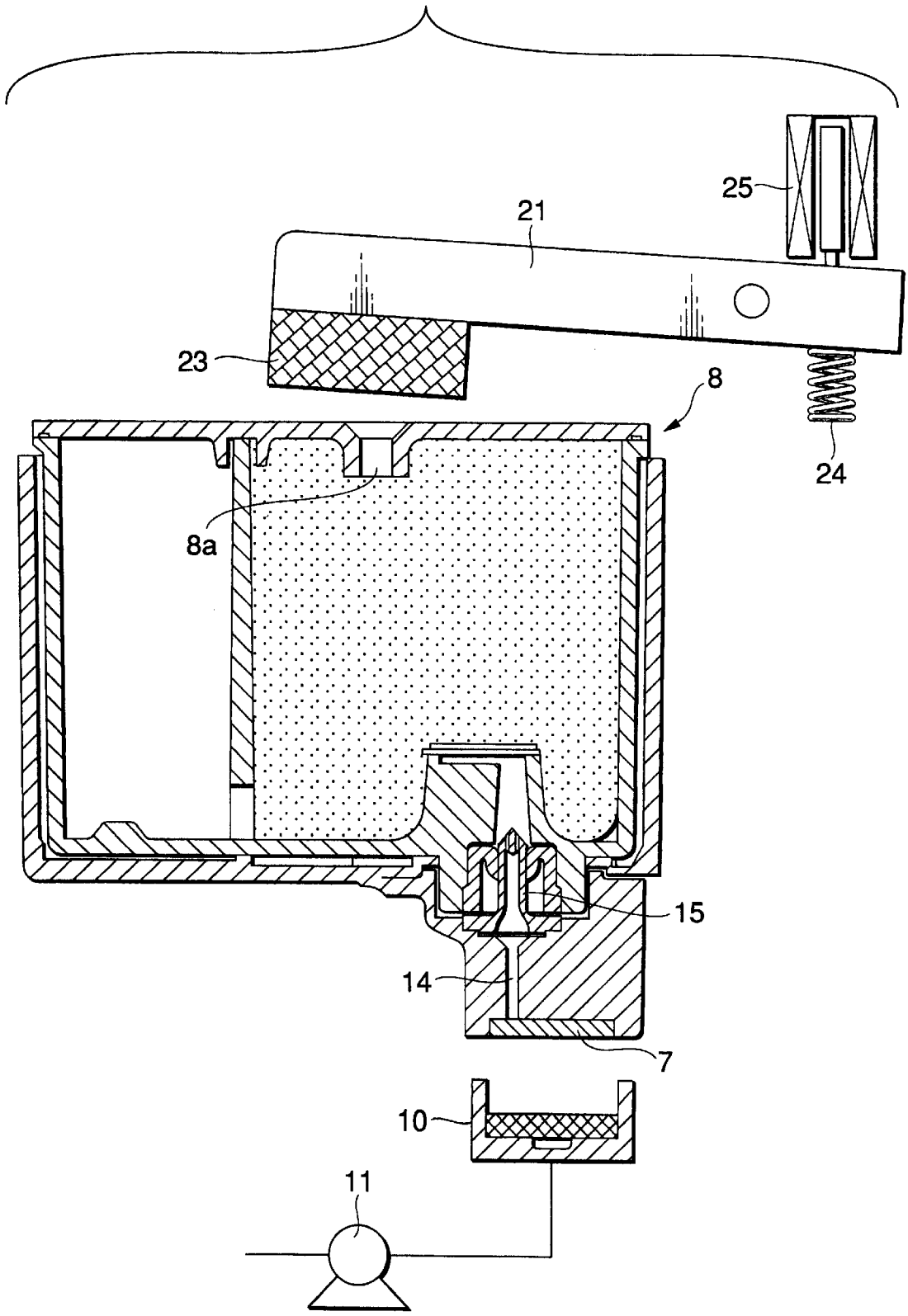
FIGS. 4(*a*) and 4(*b*) are diagrams each showing a state in which the sealing means has been removed from ink cartridge and a state in which the sealing means is sealing the ink cartridge.
Figure 4B:
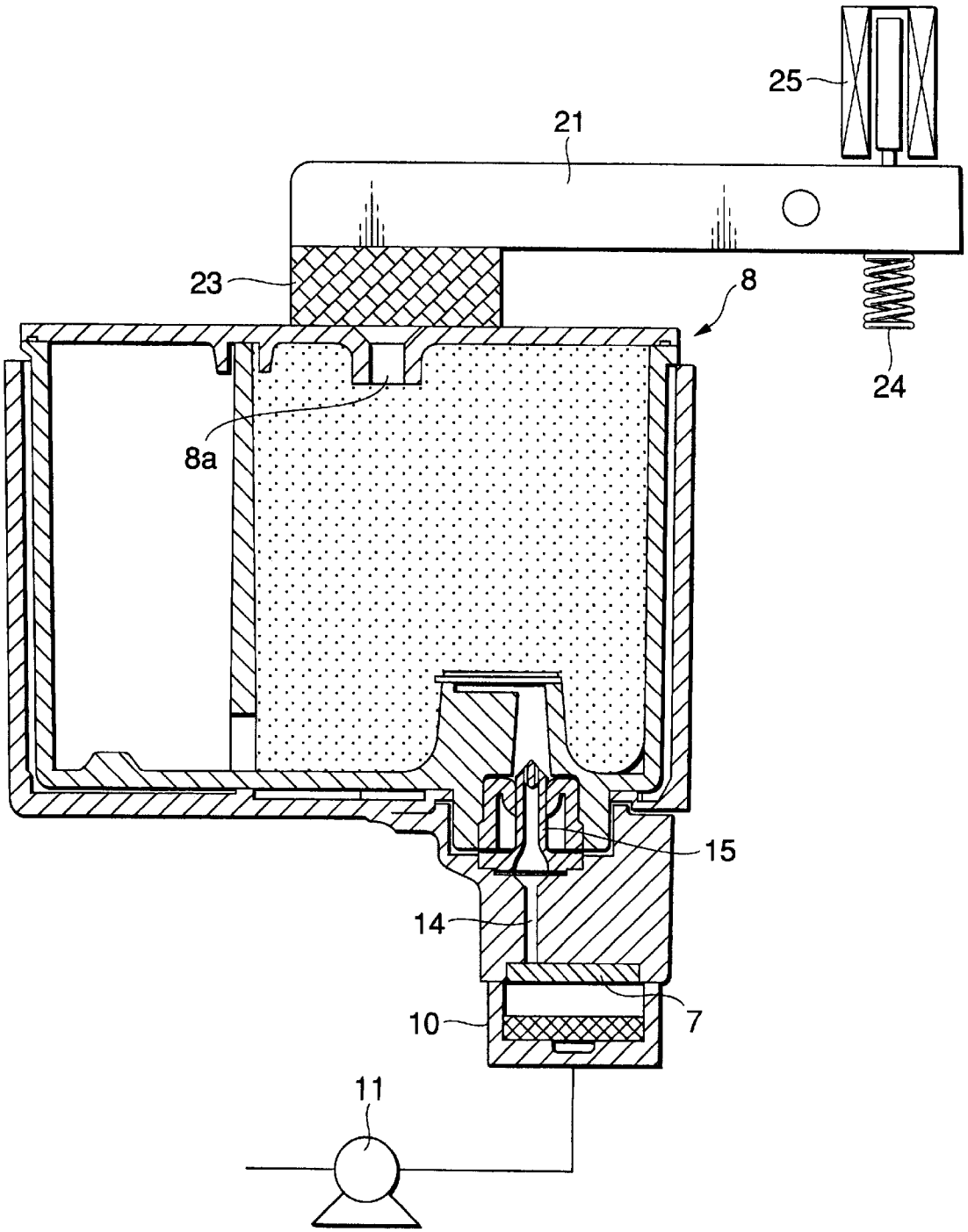

If an operation for restoring the recording head 7 to be capable of discharging ink is required because a printing operation has been continued for a predetermined time, the carriage 1 is moved toward the capping unit 10. At this time, the drive member 25 is activated whereby the arm 21 of the cartridge sealing mechanism 20 is urged by the drive member 25 and thus the arm 21 is removed from the movement passage for the ink cartridge 8, as shown in FIG. 4(*a*). Therefore, the carriage 1 and the recording head 7 can be moved to positions at which they face the capping unit 10 without any obstacle. In the foregoing state, a drive signal similar to the drive signal which is supplied when the printing operation is performed, is supplied to the recording head 7. Thus, ink droplets are discharged from all openings of the nozzle. As a result, ink existing near the openings in the nozzle and having raised viscosity can be discharged to the capping unit 10. Then, ink droplets can be discharged normally.

If the state of interruption is continued for a long time or if an ink droplet cannot be discharged normally during the printing operation, the carriage 1 is moved to the position of the capping unit 10. Thus, the recording head 7 is sealed by the capping unit. Then, the spring 24 is urged so that the arm 21 is rotated in the counter-clockwise direction in FIG. 3.

As a result, the sealing member 23 is elastically pressed against the air-communicated opening 8*a* of the ink cartridge 8, as shown in FIG. 4(*b*).

In the foregoing state, the suction pump 11 is operated to apply negative pressure to the capping unit 10 so that ink accommodated in the ink cartridge 8 and having a relatively small quantity of dissolved air is introduced into the recording head 7. Thus, air bubbles introduced into the recording head 7 are dissolved in ink so that the air bubbles are contracted. Moreover, the air bubbles are, along the flow of ink, discharged to the capping unit 10 through the openings in the nozzle together with ink.

In the foregoing state, the air-communicated opening 8*a* of the ink cartridge 8 is sealed by the sealing member 23 so that communication with the atmosphere is stopped. Therefore, the ink cartridge 8 does not excessively discharge ink and the pressure in the ink cartridge 8 is reduced until the pressure is brought into a condition of equilibrium with the sucking force of the ink suction pump 11. As a result of the reduction in the pressure, air dissolved in the ink in the ink cartridge 8 is formed into air bubbles and liberated, after which the air bubbles are discharged into a space in the ink cartridge 8, and then discharged to the outside through the air-communicated opening 8*a* Thus, the degree of deaeration of ink in the ink cartridge 8 can be restored. Hence, the fluid characteristic which determines the ink discharging performance can be restored.

When a required degree of deaeration has been realized, energization of the drive member 25 is performed for a short time. Thus, the arm 21 is rotated by the urging force of the drive member 25 so that the sealing member 23 is separated from the ink cartridge 8. As a result, ink in the ink cartridge 8 is allowed to communicate with the atmosphere through the air-communicated opening 8*a*. Thus, a great differential pressure is generated between the portion of the recording head 7 adjacent to the openings in the nozzle and the portion of the recording head 7 adjacent to the cartridge 8. As a result, ink in the recording head 7 flows at a high speed for a short time, thus causing air bubbles in the recording head, which have not been removed completely, to be discharged to the capping unit 10.

After a predetermined period of time has elapsed, the drive member 25 is again deactivated to suspend the communication between ink in the ink cartridge 8 and the atmosphere. In the foregoing state, the suction pump 11 is operated for a predetermined time, and then the operation of the pump 11 is interrupted. When discharge of the ink from the recording head 7, which is attributable to residual pressure after the interruption of the operation of the pump, has been stopped, the drive member 25 is de-energized to cause ink cartridge 8 to communicate with the atmosphere. Thus, the ink cartridge 8 is first restored to atmospheric pressure, and then the recording head 7 is separated from the capping unit 10. As a result, any counterflow of ink from the recording head 7 to the ink cartridge 8 is prevented. Then, the operation for restoring the ink discharge is completed.

After ink in the ink cartridge has sufficiently been deaerated as described above, air bubbles can easily be dissolved in the ink so as to disappear. When only ink having no air bubbles is discharged, air bubbles in the fluid passage can be discharged As a result, the quantity of ink required to remove air bubbles can be reduced. If a large quantity of air is dissolved in the ink in the cartridge, ink in a large quantity is required to discharge the air bubbles along the flow of ink as discussed with conventional apparatuses.

The above-mentioned embodiment has the structure that the cartridge is divided into two chambers and ink is supplied through the elastic and porous member. As a matter of course, a structure for accommodating only ink or a structure accommodating only the porous member is able to attain similar effect.

Figure 5:
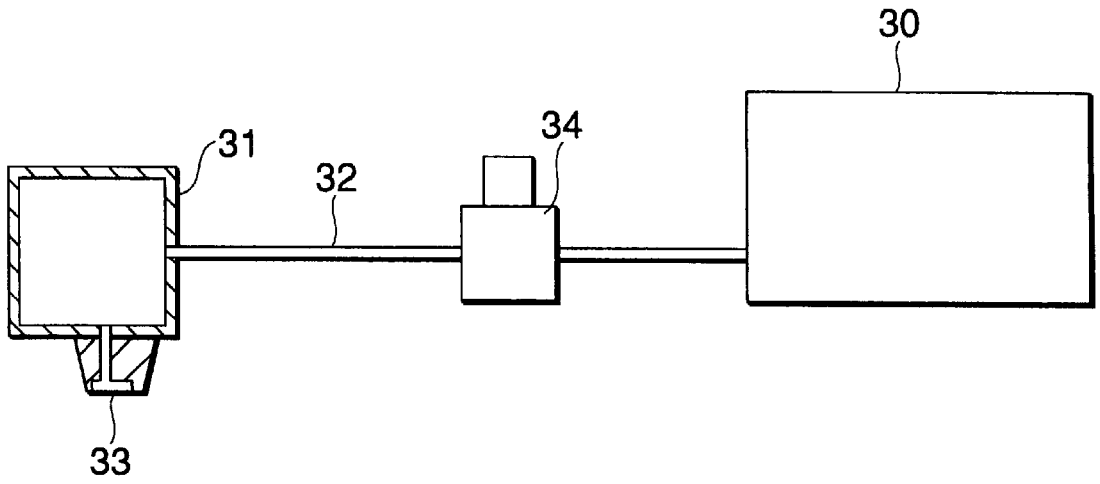
FIG. 5 is a diagram showing another embodiment of the present invention.

The above-mentioned embodiment has been described with respect to the recording apparatus having the ink cartridge 8 mounted on the carriage. However, the present invention may be applied to a recording apparatus of another embodiment as shown in FIG. 5, wherein an ink cartridge 30 is mounted on a base and a sub-tank 31 having a damper function capable of damping change in the pressure is mounted on the carriage. Moreover, an ink tube 32 establishes the connection between the ink cartridge 30 and the sub-tank 31 so as to supply ink to a recording head 33 through the sub-tank 31. In this case, a structure may be employed in which a valve 34 is disposed at an intermediate position of the ink tube 32. The valve 34 suspends the communication with the ink cartridge 30 to apply negative pressure to the sub-tank 31 so as to deaerate only ink in the sub-tank 31 and the ink tube 32, in which ink required for performing a printing operation is reserved.

As a result, air bubbles existing in a deep portion of the recording head 33 can be removed. Moreover, ink existing in the sub-tank 31 and ink tube 32 in a sufficient quantity required to perform a printing operation for the moment can satisfactorily be deaerated.

As described above, the method according to the present invention comprises the step of inhibiting the flow of ink in the ink supply connected to the ink jet recording head and a step of applying negative pressure to the recording head to increase the negative pressure level in the recording head. Therefore, air dissolved in the ink in the ink supply can be discharged while air bubbles in the recording head and the like are dissolved in the ink and discharged together with the ink until the internal pressure in the ink reserving means is brought into a condition of equilibrium with the sucking pressure of the suction means. Thus, the degree of deaeration of ink can be improved. Moreover, a satisfactorily high degree of deaeration of ink can be maintained regardless of the period of time in which the ink cartridge is mounted. Thus, satisfactory performance for discharging ink droplets can be maintained and the quantity of ink required to remove air bubbles can be reduced.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A method of removing air bubbles in an ink supply passage in an ink jet recording apparatus, comprising:

a step of inhibiting a flow of ink from an ink supply to an ink jet recording head by sealing an air communication hole provided on said ink supply passage, wherein said ink supply is connected to said recording head; and a step of applying negative pressure to said recording head while performing said inhibiting step in order to increase the negative pressure level in said recording head.

2. A method of removing air bubbles in an ink supply passage in an ink jet recording apparatus according to claim 1, further comprising a step of causing said recording head to communicate with the atmosphere in order to discharge ink from said recording head after said negative pressure has been applied for a predetermined time so that said recording head is applied with differential pressure between the atmosphere and suction pressure of an ink suction pump.

3. A method of removing air bubbles in an ink supply passage in an ink jet recording apparatus according to claim 2, further comprising the steps of:

stopping said communication of said recording head with the atmosphere after the ink has been discharged from said recording head;

applying negative pressure to said recording head thereby causing the ink to be further discharged from said recording head;

stopping the application of negative pressure to said recording head after negative pressure is applied to said recording head for a predetermined amount of time; and opening said recording head to the atmosphere.

4. A method of removing air bubbles in an ink supply passage in an ink jet recording apparatus according to claim 1, further comprising a step of opening said recording head to the atmosphere after the ink has been allowed to flow from said ink supply to said recording head while said recording head was sealed.

5. An ink jet recording apparatus having a carriage capable of reciprocating in the widthwise direction of recording paper, an ink jet recording head mounted on said carriage, an ink cartridge to supply ink to said ink jet recording head and which is mounted on said carriage, capping means disposed in a non-printing region and arranged to seal said recording head, and suction means for applying negative pressure to said capping means, said ink jet recording apparatus comprising:

an opening communicated with the atmosphere provided in said ink cartridge; and cartridge sealing means for selectively sealing said opening communicated with the atmosphere and for inhibiting a flow of ink from said ink cartridge to said ink jet recording head while said suction means applies said negative pressure to said capping means.

6. An ink jet recording apparatus according to claim 5, wherein said cartridge sealing means comprises a rotating arm having a sealing member arranged at one end thereof.

7. An ink jet recording apparatus according to claim 5, wherein said opening directly communicates said recording head with said atmosphere.

8. An ink jet recording apparatus according to claim 5, wherein said opening introduces air into an interior of said ink cartridge so that the air contacts the ink.

9. An ink jet recording apparatus according to claim 5, wherein said cartridge sealing means is formed in said ink cartridge at a position at which said recording head is sealed by said capping means.

10. An ink jet recording apparatus comprising:

a carriage capable of reciprocating in the widthwise direction of a recording paper;

an ink jet recording head mounted on said carriage;

an ink cartridge to supply ink to said recording head, said ink cartridge having an opening communicated with the atmosphere and being mounted on said carriage;

a capping unit disposed in a non-printing region and arranged to seal said recording head;

an ink suction pump for applying negative pressure to said capping unit; and a cartridge sealing mechanism for selectively sealing said opening at a position at which said recording head is sealed by said capping unit and for inhibiting a flow of ink from said ink cartridge to said ink jet recording head while said ink suction pump applies said negative pressure to said capping unit.

11. An ink jet recording apparatus according to claim 10, wherein said cartridge sealing mechanism comprises a rotating arm having a sealing member arranged at one end thereof.

12. An ink jet recording apparatus according to claim 10, wherein said opening directly communicates said recording head with said atmosphere.

13. An ink jet recording apparatus according to claim 10, wherein said opening introduces air into an interior of said ink cartridge so that the air contacts the ink.

14. A method of removing air bubbles in an ink supply passage in an ink jet recording apparatus, in which an ink supply is provided with an air-communicated opening to define a predetermined pressure difference inside the ink supply relative to an atmosphere, and the ink supply is connected to a recording head so that an ink ejection from the recording head for printing is carried out while keeping the predetermined pressure difference, said method comprising the steps of:

closing the air-communicated opening; and applying negative pressure through said recording head to said ink supply with the air-communicated opening closed to define a larger pressure difference inside the ink supply than the predetermined pressure difference.

15. An ink jet recording apparatus having a carriage capable of reciprocating in the widthwise direction of recording paper, an ink jet recording head mounted on said carriage, an ink cartridge to supply ink to said recording head and which is mounted on said carriage, capping means disposed in a non-printing region and arranged to seal said recording head, and suction means for applying negative pressure to said capping means, said ink jet recording apparatus comprising:

an opening communicated with the atmosphere provided in said ink cartridge; and cartridge sealing means for selectively sealing said opening communicated with the atmosphere and formed in said ink cartridge, at a position at which said recording head is sealed by said capping means, wherein said suction means applies the negative pressure to said capping means when said recording head and said opening are respectively sealed by said capping means and said cartridge sealing means.

16. The ink jet recording apparatus according to claim 15, wherein said cartridge sealing means is released from said opening to communicate said opening with the atmosphere while said suction means continuously applies the negative pressure to aid capping means sealing said recording head.

17. An ink jet recording apparatus comprising:

a carriage capable of reciprocating in the widthwise direction of a recording paper;

an ink jet recording head mounted on said carriage;

an ink cartridge to supply ink to said recording head, said ink cartridge having an opening communicated with the atmosphere and being mounted on said carriage;

a capping unit disposed in a non-printing region and arranged to seal said recording head;

an ink suction pump for applying negative pressure to said capping unit; and a cartridge sealing mechanism for selectively sealing said opening at a position at which said recording head is sealed by said capping unit;

wherein said capping unit said ink suction pump and said cartridge sealing mechanism cooperatively establish a first state in which the negative pressure is applied to an interior of the ink cartridge with the opening searingly isolated from the atmosphere.

18. The ink jet recording apparatus according to claim 17, wherein said capping unit, said ink suction pump and said cartridge sealing mechanism cooperatively establish a second state, subsequently to the first state, in which the opening is communicated with the atmosphere to generate a great differential pressure between a portion of the recording head adjacent the capping unit and a portion of the recording head adjacent to the interior of the ink cartridge.

* * * * *